United States Patent [19]

Franc

[11] 4,148,157

[45] Apr. 10, 1979

[54] METAL CLAD DOOR

[76] Inventor: Paul Franc, 189 rue Duguesclin, Lyon 3, Rhone, France

[21] Appl. No.: 741,574

[22] Filed: Nov. 15, 1976

[51] Int. Cl.[2] ..... E06B 3/00

[52] U.S. Cl. ..... 49/501; 49/503; 52/827

[58] Field of Search ..... 49/501, 503; 52/620, 52/623, 621

[56] References Cited

U.S. PATENT DOCUMENTS

| | | | |
|---|---|---|---|
| 849,742 | 4/1907 | Mandry | 49/503 |
| 990,151 | 4/1911 | Mayo | 52/620 |
| 1,091,905 | 3/1914 | Zahner | 52/620 X |
| 2,924,861 | 2/1960 | Viets | 49/503 X |
| 3,186,528 | 6/1965 | Bohnsack | 49/503 |
| 3,263,370 | 8/1966 | Martinez | 49/501 |
| 3,334,464 | 8/1967 | Charles | 49/501 X |
| 3,599,703 | 8/1971 | Mennoto et al. | 49/501 X |
| 3,987,588 | 10/1976 | Imperial | 49/501 |

*Primary Examiner*—Philip C. Kannan
*Attorney, Agent, or Firm*—Remy J. VanOphem

[57] ABSTRACT

The invention concerns a new type of metal clad door. The metal clad door according to the invention is built from a unique internal metal frame with two external panels of galvanized sheet metal on either side of the frame. A sheet of insulating material such as polyurethane foam fills the space defined by the internal frame and the two external panels. The external panels are surrounded by a wooden edging which is mounted to the internal frame. The wooden edging surrounding the metal clad door provides easy fitting and adjustment since modifications which are to be made to the external dimensions are carried out very quickly by planing the wooden edging. Further, the door, according to this invention, gives a sound insulation much superior to the traditional doors with either wooden or metal external panels.

11 Claims, 12 Drawing Figures

METAL CLAD DOOR

BACKGROUND OF THE INVENTION

The present invention concerns a new type of metal clad door.

In housing of modern construction it is usual to fit landing doors of flats made up of a thick sheet of insulating material surrounded by a wooden frame and glued between two thin sheets of wood.

Doors of this type are very easily broken into and they are, in addition, very permeable to noise. The occupiers of the dwellings who wish to avoid breaks-in, must therefore call in specialists who proceed to reinforce the landing doors. It is a costly operation, and the results obtained may be more or less satisfactory.

SUMMARY OF THE INVENTION

A metal-clad door according to the invention is characterised in that it comprises a combination of:

— an internal metal framing,

— two external panels of galvanised sheet metal, fixed one on either side of the internal framing, — a sheet of insulating material filling a space defined between the internal framing and the two external panels, — four wooden edgings to surround the internal framing and the two external panels.

Following an additional characteristic of the invention, each external panel has the exterior visible face covered with a protective and decorative layer of polyvinyl chloride.

Following another additional characteristic of the invention, the insulating sheet is constituted by a sheet of polyurethane foam or a multi-layer panel of non-inflammable quality applied to either side of the external sheet metal panels.

Following a variant of the invention, the insulating sheet is constituted by a block of foam injected in situ to the inside of the caisson.

Following an additional characteristic of the invention, the internal metal framing comprises:

— a frame constituted by a U-member with the two wings parallel to the large faces of the door and partially engaged on each side of wooden edgings.

— vertical reinforcements constituted by L-shaped lengths, with the small face attached to the bottom of the U-member forming the frame, and the large face parallel to the large faces of the door, — at least one tubular horizontal crosspiece, with a square or rectangular section, welded between the vertical reinforcements.

Following a variant of the invention, the internal metal framing comprises:

— a frame made of a section comprising a central wall which is at right angles to the large faces of the door, one edge of which is attached to a small rib perpendicular to the said central wall and partially covering the wooden edgings, and of which the other edge is attached to a large rib parallel to the small rib but turned in the opposite direction and engaged between the external panel and the insulating sheet, — reinforcements constituted by small plates attached to a part of the central wall of the section, or by lengths of angle iron attached to the central wall and the large rib of the section, the reinforcements being in both cases placed on the internal face of the caisson.

Following an additional characteristic of the invention, the two external panels are attached to the framing by means of spot welds.

Following a variant of the invention, at least one of the two external panels is attached to the framing by the lapping of its edges over one wing of the frame.

Following an additional characteristic of the invention, the wooden edgings are fixed by means of screws with their axes parallel to the large faces of the door, screwed into the internal metal framing, their heads bearing against the bottom of a hole opening on an external face of the edgings, these holes being plugged by wooden pegs.

Following an additional characteristic of the invention, the door is fitted with at least two hinges, each hinge being attached to a right-angled fixing plate, with one wing being engaged between one wooden edging and one external panel, and the other wing engaged between the wooden edging and the framing, this latter wing being welded to the framing.

Following an additional characteristic of the invention, the door is fitted with a mortice lock of which the main body is set into the interior of the caisson against the metal framing, the transverse wall of which is pierced with a hole which extends in the prolongation of a hole in the wooden edging parallel to the large faces of the door, to allow the passage of a lengthened bolt of the said lock.

According to another variant of the invention, the door is fitted with a lock attached to one of its large faces and fixed with screws into the internal framing, or into one of the external panels, or into the framing and the panel.

BRIEF DESCRIPTION OF THE DRAWINGS

The attached drawing, given by way of non-limiting example, will allow the characteristics of the invention to be better understood.

DESCRIPTION OF THE PREFERRED EMBODIMENT

Figure 1:
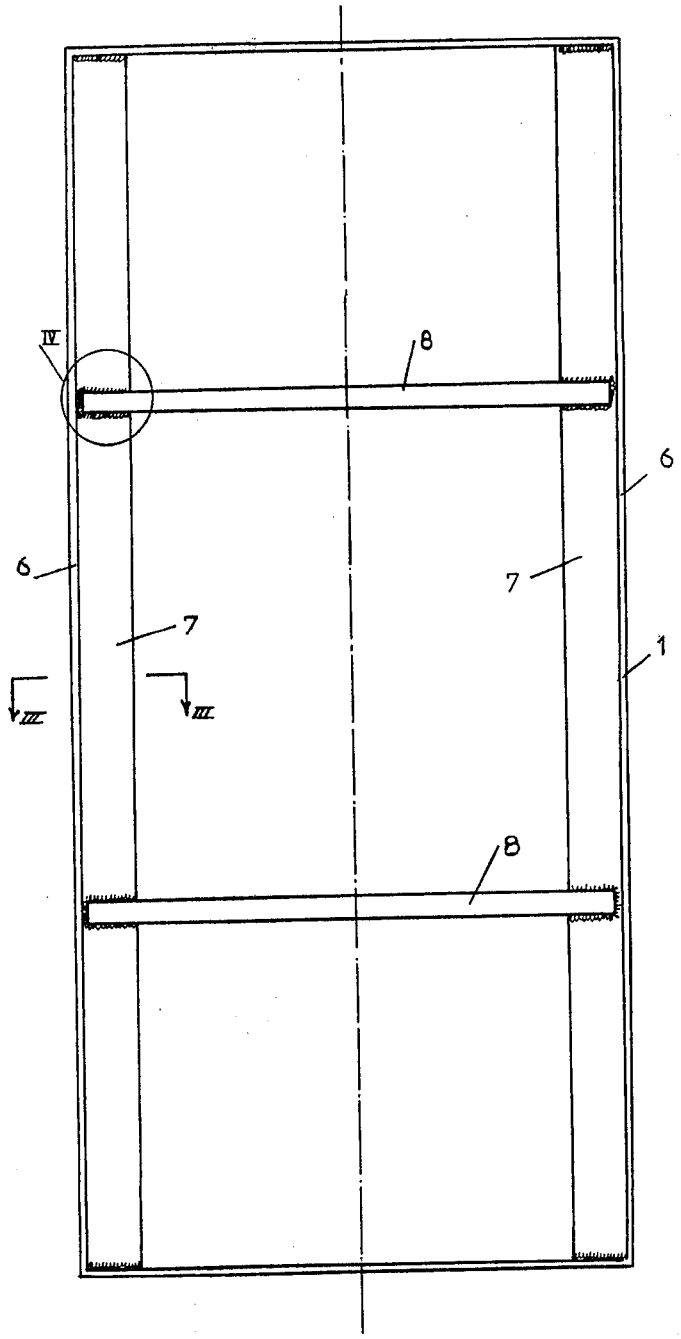
FIG. 1 is a front view of a metal-clad door according to the invention, showing its internal framing.
Figure 2:
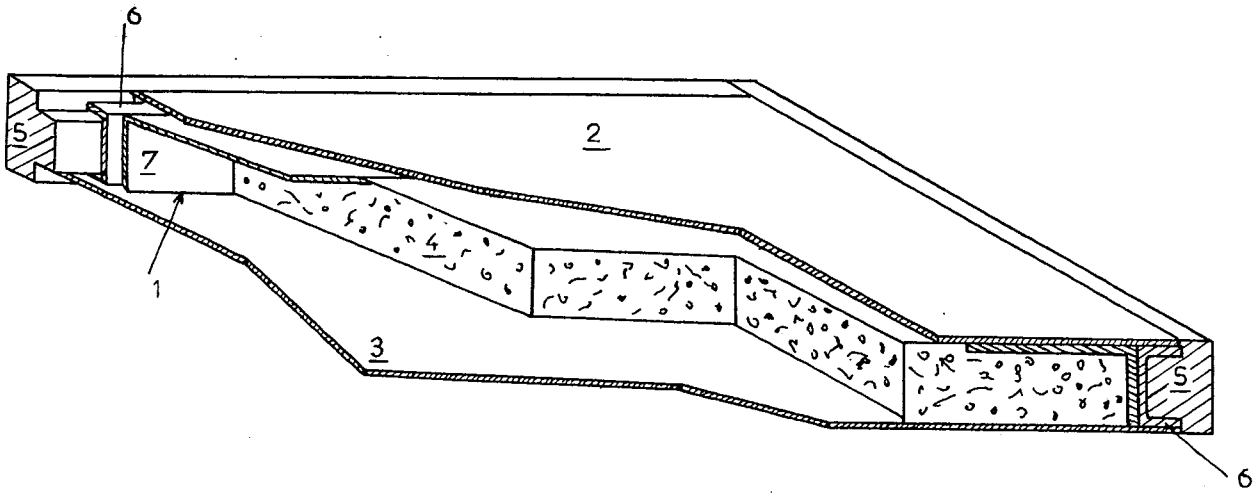
FIG. 2 is an overall view of the sectioned door in perspective.

There is shown in the FIGS. 1 to 4, a door according to the invention comprising:

— an internal metal framing 1,

— two external panels 2 and 3,

— an internal sheet of insulating material 4,

— four wooden edgings 5.

The framing 1 comprises a body constituted by a U-section 6 of which the two wings are turned towards the edgings 5, and of which the bottom is attached to the small face of an L-section 7 which constitutes a reinforcement of the framing. The large face of the L-section 7 is parallel to the panels 2 and 3. Two horizontal cross members 8 made from square section tube are engaged in apertures in the large face of the L-section 7 (FIG. 4), so as to present an external surface level with the external surfaces of the L-section 7 and the U-section 6.

This metal framing is made entirely from galvanised sheet metal and assembled by electric welding. The welds are given a protecting coat of anit-rust paint.

The external panels 2 and 3 are constituted by galvanised sheets and are covered on their visible external face with a protective and decorative cladding of polyvinyl chloride. These panels are lapped on to the framing by a peripheral fold over the wings of the U-section 6. The insulating sheet 4, which may have for example a thickness of 4 cm, is stuck between the panels 2 and 3 by means of a special adhesive.

Following a variant, the sheet 4 is formed by injection in situ of polyurethane foam. In all cases, the insulating material will be of non-inflammable quality.

Figure 10:
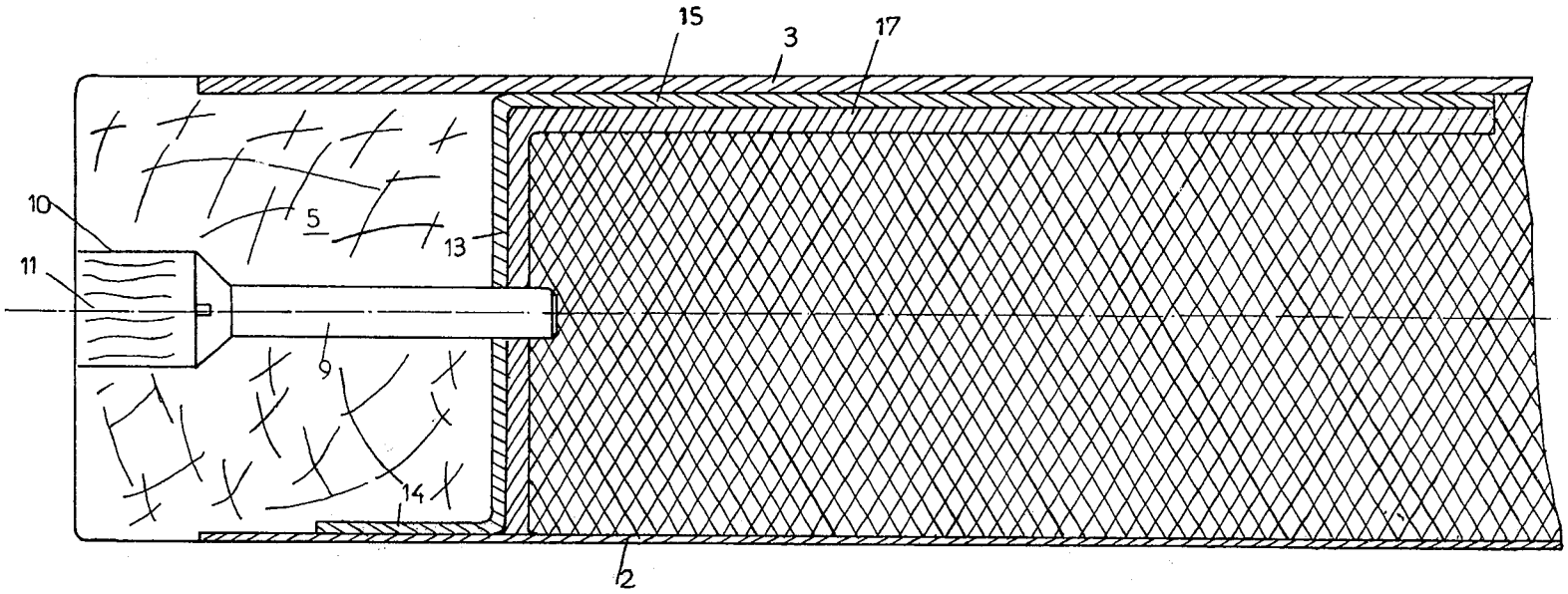
FIG. 10 is a section along X—X (FIG. 6)

The edgings 5, which completely surround the metal framing 1, and the external panels 2 and 3, carry on their opposing lateral faces seatings for the wings of the U-section 6, so that these faces form a prolongation of the external faces of the panels 2 and 3. The edgings 5 are fixed to the framing 1 by adhesive and by means of screws 9, screwed parallel to the panels 2 and 3 into the bottom of the U-section 6, and into the small face of the L-section 7. The head of each screw 9 is tightened into the bottom of a hole 10 which opens externally and which is plugged by means of a wooden peg 11 as shown in FIG. 10.

One of the advantages of this metal-clad door lies in the ease of its fitting and adjustment, since possible modifications to be made to its external dimensions are carried out very quickly by planing the wooden edgings.

In addition, experience shows that such a door gives a sound insulation much superior to traditional doors with wooden external panels.

Following a variant shown in FIGS. 5 to 10, the framing 1 comprises a body made from a section 12 comprising a central wall 13 perpendicular to the panels 2 and 3, a small wing 14 turned towards the edgings 5 and a large wing 15 turned towards the insulating sheet 4. The section 12 has a stepped right-angle cross section, the wings 14 and 15 being parallel to the panels 2 and 3. These wings 14 and 15 are directly in contact with the internal faces of the panels 2 and 3 respectively. The wall 13 is attached to four small reinforcing plates 16 and two lengths of angle iron 17 are fixed between the wall 13 and the wing 15.

The panels 2 and 3 are fixed to the frame 1 this time by spot welds.

One of the two vertical edges of the door is fitted with three hinges 18. Each hinge is attached to a right-angled fixing plate comprising one wing 19 engaged between the edging 5 and the panel 3, and one wing 20 engaged between the wall 13 and the edging 5. The wing 20 is weleded to the wall 13. The three hinges are situated respectively level with the two strengthening plates 16 and the strengthener 17. It will be understood that the hinges are fixed in virtually the same manner to the door shown in FIG. 3.

Figure 11:
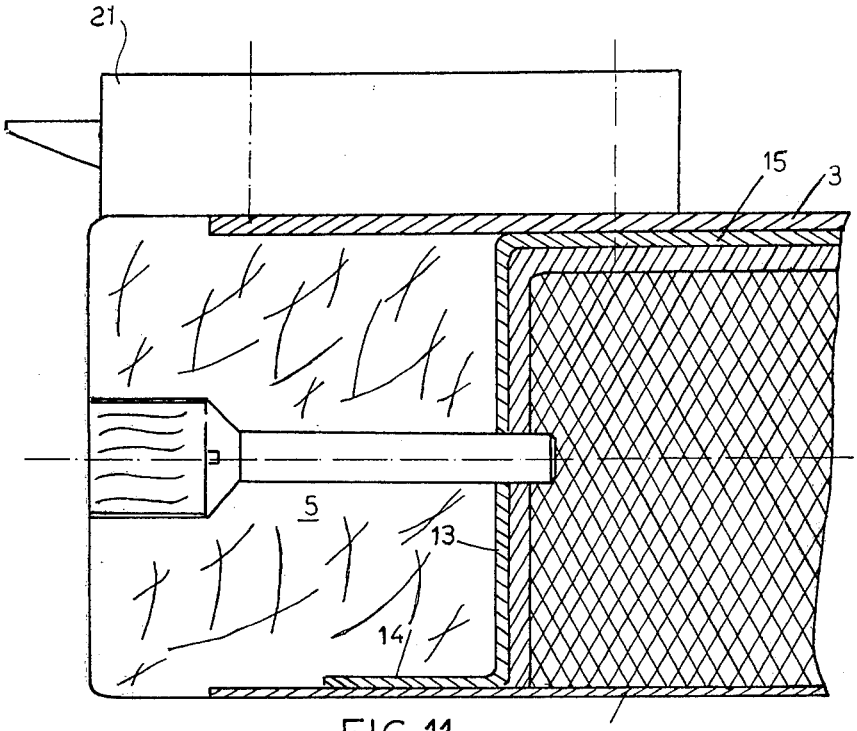
FIG. 11 is a section along XI—XI (FIG. 6)

The other vertical edge of the door is fitted with a lock 21 which is fixed by means of screws engaging on the one hand in the panel 3 and on the other hand simulataneously in the panel 3, the wing 15 and a strenthener 17 (FIG. 11).

Figure 3:
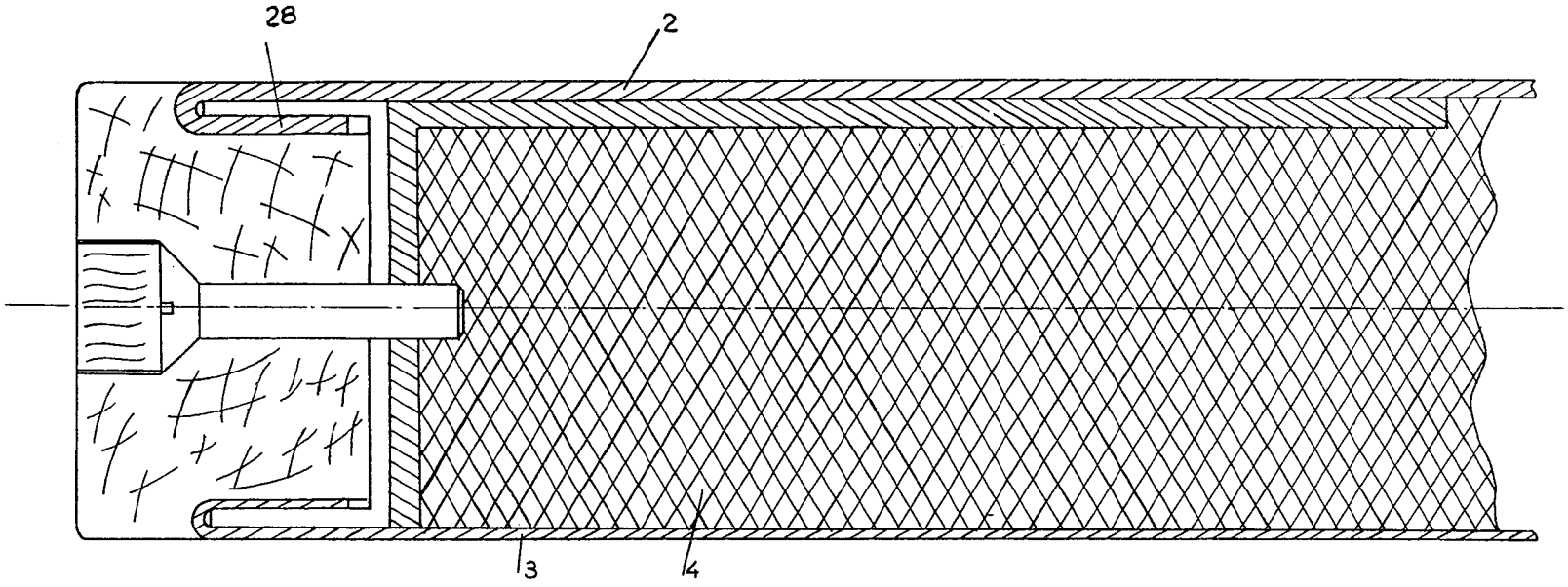
FIG. 3 is a section III—III (FIG. 1)
Figure 4:
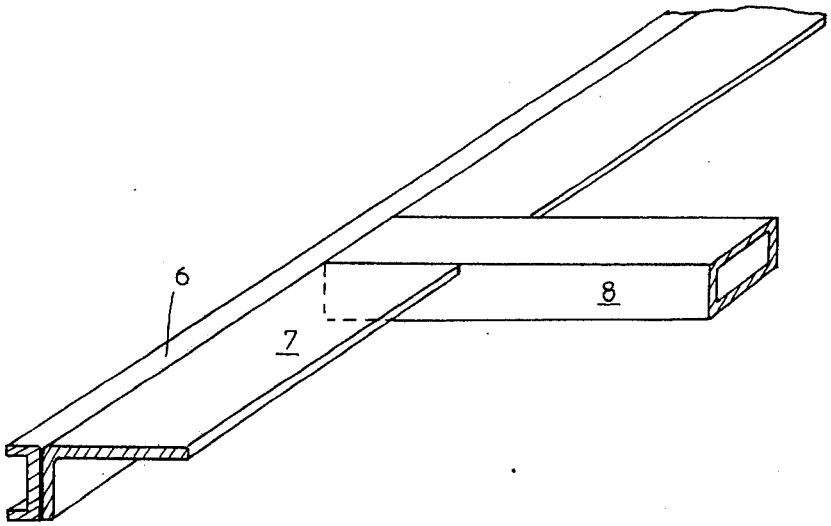
FIG. 4 is a part view in perspective of IV (FIG. 1)
Figure 5:
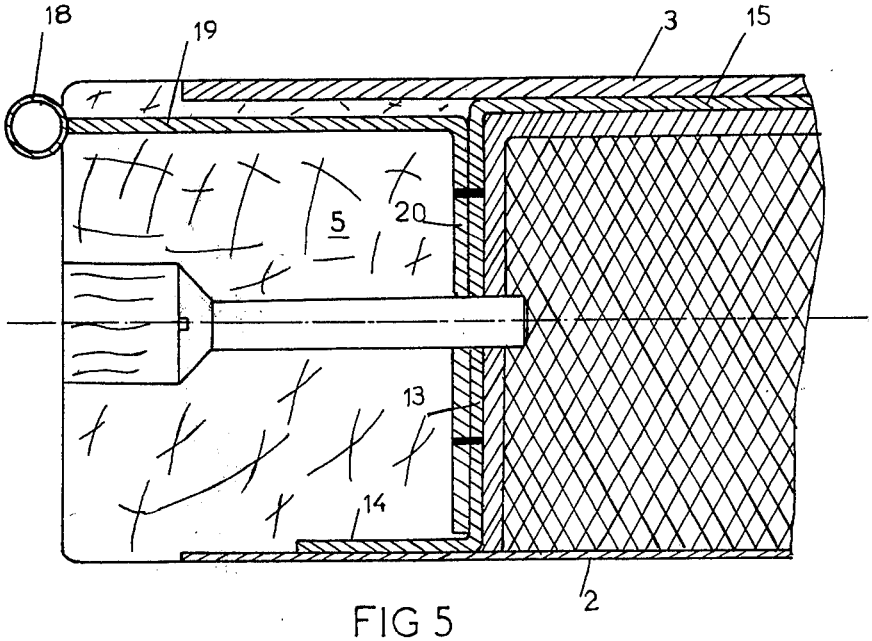
FIG. 5 is a section V—V (FIG. 6)
Figure 6:
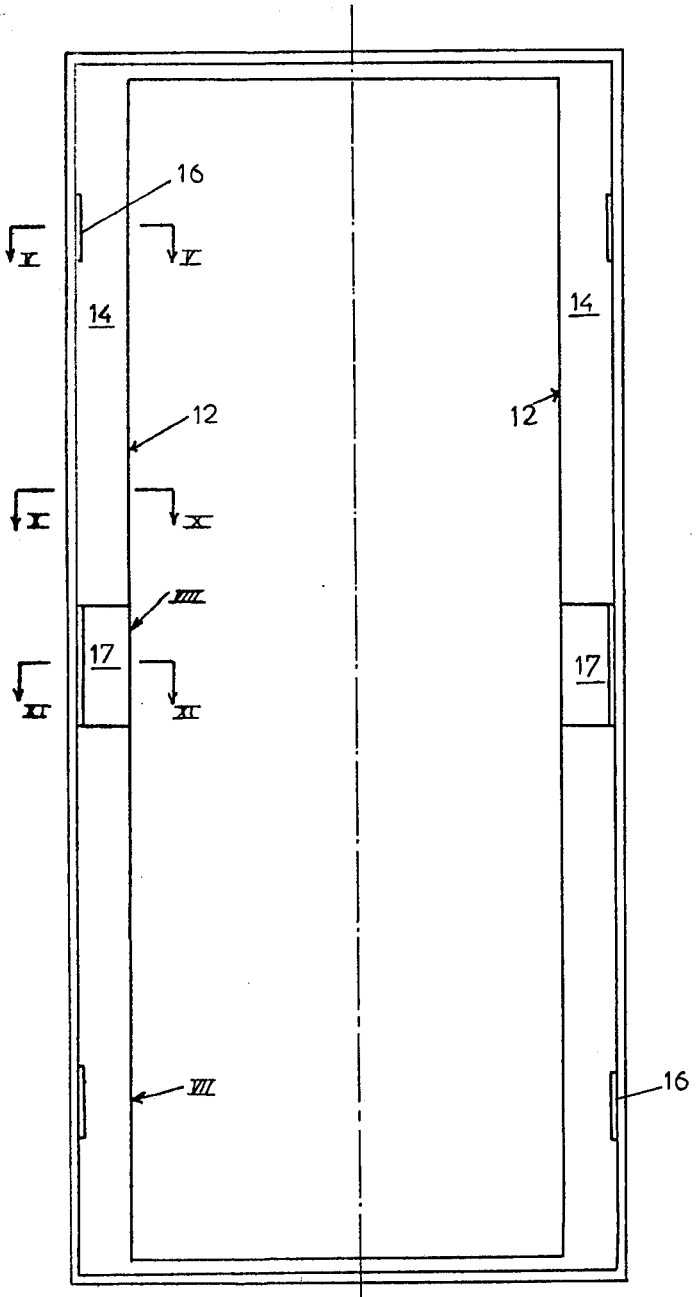
FIG. 6 is a front view of a metal-clad door according to a variant of the invention, showing its internal framing.
Figure 7:
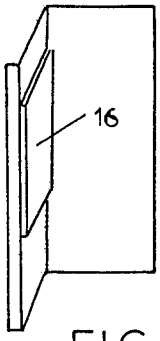
FIG. 7 is a part view in perspective of VII (FIG. 6)
Figure 8:
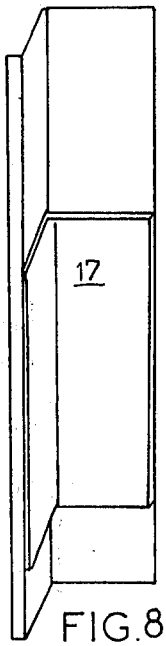
FIG. 8 is a part view in perspective of VIII (FIG. 6)
Figure 9:
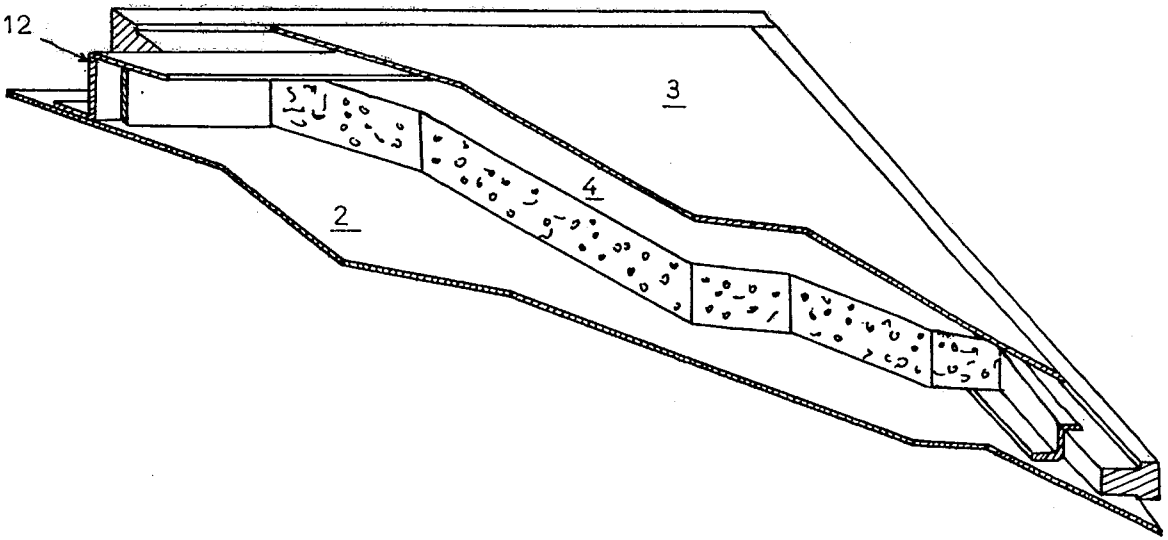
FIG. 9 is an overall view of the door according to the variant of FIG. 6, in sectioned perspective.
Figure 12:
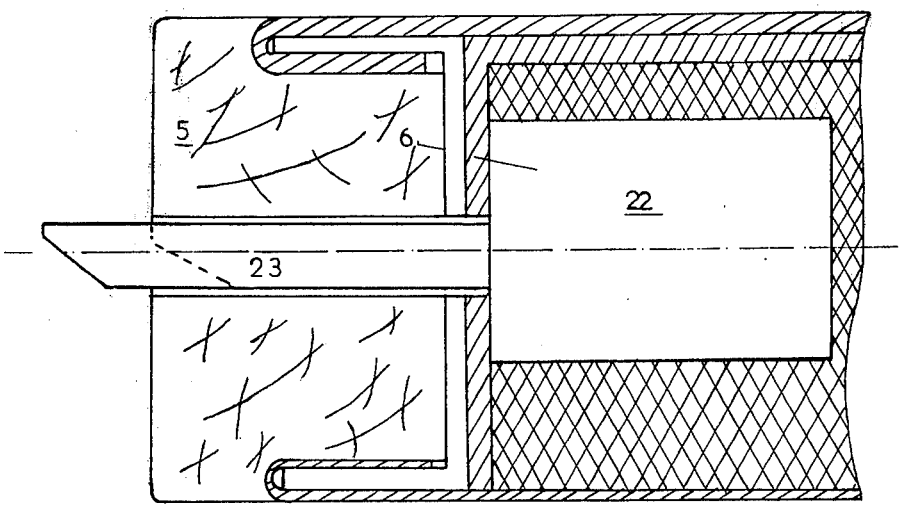
FIG. 12 is a section of an alternate embodiment of a lock means along section line XI—XI (FIG. 6).

Following a variant, there is shown in FIG. 12, a mortice lock 22 let into the thickness of the door as shown in FIG. 3. This lock is fixed against the internal face of the small face of the L-section 7, and it is furnished with a lengthened bolt 23 which successively passes through the L-section, the U-section 6 and the edging 5.

Following other variants which are not shown, the metal-clad door according to the invention may be fitted with different models of safety locks, for example with multiple bolts. It may in addition have various accessories such as an optical peep hole or an automatically closing lower draught excluder.

The external faces of the panels 2 and 3 may be delivered without cladding, ready for painting. It is in addition possible to stick on to these faces period beading or any other accessory of this type used in decoration.

While the preferred embodiment of the invention has been disclosed it will be apparent to those skilled in the art that changes may be made to the invention as set forth in the claims and, in some instances, certain features of the invention may be used without corresponding use of other features. Accordingly, it is intended that the illustrative and descriptive material herein be used to illustrate the principles of the invention and not to limit the scope thereof.

What I claim is:

1. A metal clad door comprising:

at least two metallic panel members;

an internal unitary metallic frame member mounted between said at least two metallic panel members, said unitary frame member being continuous for the entire peripheral length of said metal clad door, said internal unitary metallic frame member further comprising:

a body member having a cental wall portion perpendicular to said at least two metallic panel members; and at least two wing portions perpendicular to said wall portion and parallel to said at least two metallic panel members, said central wall portion, and at least two wing portions being integral to define the cross sectional configuration of said body member;

means for reinforcing said body member, said reinforcing means mounted to said central wall portion of said body member and at least one of said two wing portions of said body member;

a resilient insulation member interposed said at least two metallic panel members and said unitary metallic frame member;

a wood edging member mounted to said unitary metallic frame member and surrounding the outer periphery of said at least two metallic panel members;

means for attaching said edging member to said unitary metallic frame member; and means for mounting said at least two metallic panel members to said unitary metallic frame member.

2. A metal clad door as claimed in claim 1 wherein said at least two metallic panel members have a visible exterior face covered with a protective layer of decorative polyvinyl chloride.

3. A metal clad door as claimed in claim 1 wherein said resilient insulation member further comprises:

a sheet of polyurethane foam interposed said at least two metallic panel members and said unitary metallic frame member; and means for mounting said polyurethane foam to said unitary metallic frame member and said at least two metal panel members.

4. A metal clad door as claimed in claim 1 wherein said resilient insulating member is made from a non-inflammable polyurethane foam injected into the space defined by said at least two metallic panel members and said unitary metallic frame member.

5. A metal clad door as claimed in claim 1 wherein said metallic means for mounting said at least two metallic panel members to said unitaty metallic frame member comprises a plurality of spot welds, so that said at least two metallic panel members may be welded to said unitary metallic frame member,

6. A metal clad door as claimed in claim 1 wherein said means for attaching said edging member to said unitary metallic frame member further comprises:

a bore within said wooden edging member, said bore having a reduced diameter portion;

a threaded member mounted within said reduced diameter portion of said bore, said threaded member communicating with said unitary metallic frame member and further having its central axis parallel to said at least two metallic panel members; and a wooden plug member mounted within said bore bearing against said threaded member.

7. A metal clad door as claimed in claim 1 further having a means for hinging said door, said hinging means further comprising:

at least two right angle fixing plates having two wings, one of which is interposed said central wall portion of said body member and said wood edging member, said other of said two wings being parallel to said at least two metallic panel members and engaging said wooden edging member;

at least one hinge attached to said other wing of said at least two right angle fixing plates; and means for mounting said wings of said right angle fixing plate to said central wall portion of said body member.

8. A metal clad door as claimed in claim 1 further comprising:

an aperture within said wooden edging member;

a mortise lock mounted within said aperture, said mortise lock further having a main body member mounted adjacent said central wall portion of said body member; and a lengthened bolt parallel to said at least two metallic panel members protruding from said aperture within said wooden edging member.

9. A metal clad door as claimed in claim 1 further comprising a lock member mounted to said one of at least two metallic panel members; and means for mounting said lock member to one of said at least two metallic panel members.

10. A metal clad door as claimed in claim 1 wherein said central wall portion and said at least two wing portions of said body member of the unitary metallic frame member are arranged to form a "U" shaped body member having said at least two wing portions and said central wall portion communication with at least two metallic panel members and said wooden edging member and wherein said reinforcing means further comprises:

a plurality of "L" shaped reinforcing members having the shorter of their two sides attached to said central wall portion of said "U" shaped body member, said plurality of "L" shaped reinforcing members further having the longer of their two sides interposed one of said at least two metallic panel members and said resilient insulation member, said longer side further being parallel to said at least two metallic panel members; and at least one cross piece member welded to said plurality of "L" shaped reinforcing members.

11. A metal clad door as claimed in claim 10 wherein said means for mounting said two metallic panel members to said unitary frame member further comprises:

at least one of said metallic panel members further having an edge around its periphery, said edge being curled over one of said at least two wing portions of said "U" shaped body member.

* * * * *

UNITED STATES PATENT AND TRADEMARK OFFICE

CERTIFICATE OF CORRECTION

PATENT NO. : 4,148,157
DATED : April 10, 1979
INVENTOR(S) : Paul Franc

It is certified that error appears in the above-identified patent and that said Letters Patent are hereby corrected as shown below:

Column 3, line 11, delete the word "anit-rust" and insert therefore the word ----anti-rust----.

Column 5, line 16, delete the word "unitaty" and insert therefore the word ----unitary----.

Column 6, line 24, delete the word "communication" and insert therefore the word ----communicating----.

Signed and Sealed this

*Twenty-fourth* Day of *July 1979*

[SEAL]

*Attest:*

*Attesting Officer*

LUTRELLE F. PARKER
*Acting Commissioner of Patents and Trademarks*